US005590507A

United States Patent [19]

Wyssmann

[11] Patent Number: 5,590,507

[45] Date of Patent: Jan. 7, 1997

[54] PROCESS AND APPARATUS FOR PROCESSING SHEETS OF NOTES TO FORM BUNDLES OF NOTES

[75] Inventor: Hans Wyssmann, Zurich, Switzerland

[73] Assignee: De La Rue Giori S.A., Lausanne, Switzerland

[21] Appl. No.: 301,475

[22] Filed: Sep. 7, 1994

[30] Foreign Application Priority Data

Sep. 30, 1993 [CH] Switzerland ..... 02 941/93

[51] Int. Cl.[6] ..... B65B 13/02; B65B 57/00

[52] U.S. Cl. ..... 53/399; 53/435; 53/447; 53/54

[58] Field of Search ..... 53/54, 399, 447, 53/435

[56] References Cited

U.S. PATENT DOCUMENTS

| | | | |
|---|---|---|---|
| 3,939,621 | 2/1976 | Giori . | |
| 4,453,707 | 6/1984 | Kuhfuss | 53/54 |
| 4,677,910 | 7/1987 | Kuhfuss | 101/93.01 |

FOREIGN PATENT DOCUMENTS

| | | |
|---|---|---|
| 0072056 | 7/1982 | European Pat. Off. . |
| 0167196 | 6/1985 | European Pat. Off. . |
| 0286317 | 3/1988 | European Pat. Off. . |
| 1921381 | 4/1969 | Germany . |

*Primary Examiner*—Linda Johnson

*Attorney, Agent, or Firm*—Kane, Dalsimer, Sullivan, Kurucz, Levy, Eisele and Richard, LLP

[57] ABSTRACT

A sequence of H sheets of notes, for example 100 sheets, is first of all checked for misprints, and the note positions having misprints of each sheet are stored in a computer. The sheets of this sequence then pass a numbering machine (4), which has freely programmable numbering units, which are controlled by the computer. In this case, the numbering takes place in such a way that all the satisfactory note prints within the sequence of sheets, excluding the misprints, receive a consecutive sequence of numbers, the sequence of numbers of H notes in one and the same note position being the continuation of the sequence of numbers of the H notes in a neighboring note position. The next sequence of H sheets receives the subsequent sequence of numbers. After numbering, stacks of sheets (FH) having H sheets each are formed, the stacks are cut into stacks of notes (W), and these stacks of notes are fed, ordered according to consecutive numbering, to a segregation and bundling device (9), in which the misprints are removed and in each case H successive satisfactory notes are combined to form a bundle (WB) having a complete sequence of numbers. In each case ten bundles are packed to form a pack of notes (P).

6 Claims, 4 Drawing Sheets

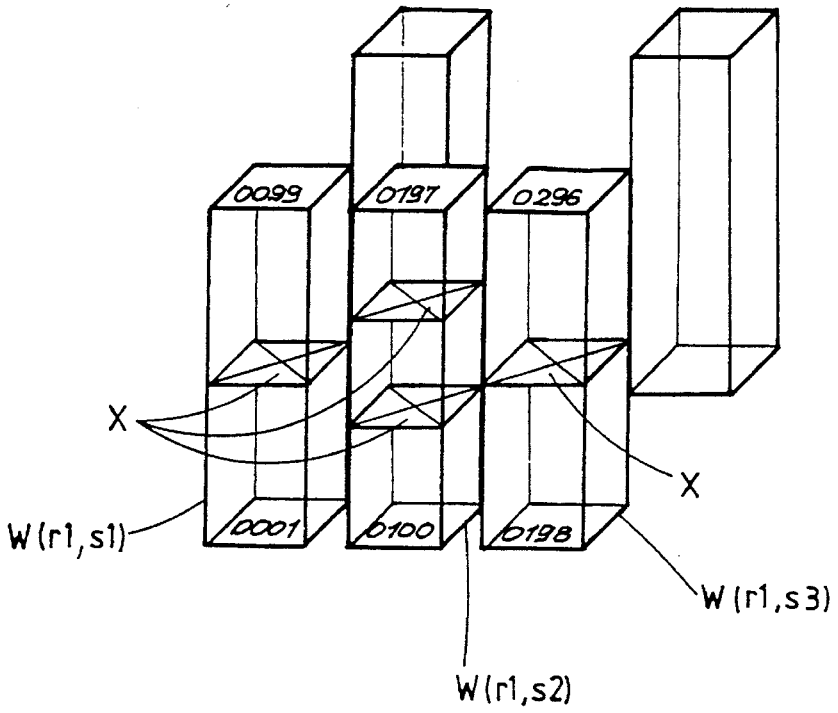
FIG. 3
FIG. 5
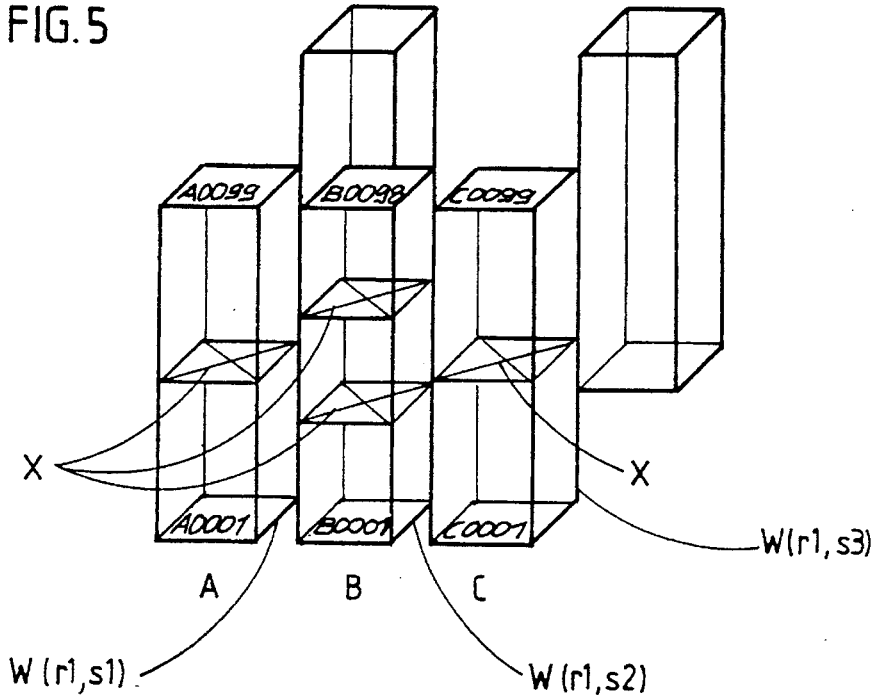

PROCESS AND APPARATUS FOR PROCESSING SHEETS OF NOTES TO FORM BUNDLES OF NOTES

FIELD OF THE INVENTION

The invention relates to a process for processing sheets of notes having a fixed number N of note prints to form bundles of notes and packs of notes from numbered individual notes of value having in each case a complete sequence of numbers, according to the preamble of claim 1 and that of claim 6, and also to apparatuses for carrying out the process.

PRIOR ART

A process and an apparatus of this type are known from EP-B-0 167 196. According to the latter, the sheets are numbered one after the other in a numbering machine in such a way that all the note prints which lie one behind the other in the transporting direction in a particular column or longitudinal row of a sheet receive consecutive numbers and this sequence of numbers continues on the note prints of the same columns of the following sheets. This consecutive numbering is continued up until completion of a closed set of numbers, which generally comprises a million numbered notes of value of a particular series. According to the known process, used for the consecutive numbering are, in particular, numbering units with digit rollers which can be switched independently of one another by electric signals, so-called freely programmable numbering units, which during numbering, on the basis of the known distribution of misprints on the individual sheets of notes, skip a misprint, which instead is preferably provided with an invalidation imprint. The numbered sheets of notes leaving the numbering machine are cut individually into notes of value; the misprints are removed from the sequence of these individual notes, and the remaining satisfactory, consecutively numbered notes are then collected and combined to form bundles having in each case a complete sequence of numbers.

According to another known process for processing sheets of notes (U.S. Pat. No. 3,939,621), the numbering is carried out in such a way that in each case all the note prints which have the same position on successive sheets, that is to say lie in the same transverse row and the same column, receive consecutive numbers, to be precise without regard for misprints, which are likewise numbered and, for the purpose of subsequent segregation, have been provided beforehand with a marking. At the output of the numbering machine, stacks of sheets with generally 100 sheets are formed, which are then cut stack by stack into bundles of notes. The misprints must then be removed from these bundles of notes and replaced by satisfactory notes, which either bear the number of a special series or have been provided beforehand in a note-numbering device with the number of the segregated misprint.

SUMMARY OF THE INVENTION

The present invention is based on the object of speeding up the process described in the preamble of claims 1 and 6 by dispensing with the time-consuming cutting of individual notes and facilitating the combining of the satisfactory notes to form bundles of notes and packs having a complete sequence of numbers. Furthermore, apparatuses for carrying out the process are to be provided.

This object is achieved according to the invention with regard to the process by the features specified in the defining part of claim 1 and of claim 6 and with regard to the apparatus by the features specified in claim 7 and claim 8.

Based on the novel method of numbering, the process according to the invention makes it possible to stack in a conventional way the sheets of notes leaving the numbering machine, then to cut these stacks of sheets into stacks of notes and remove the misprints from these stacks of notes, so that the remaining satisfactory notes directly form a sequence of notes with consecutive numbering and can be combined in a simple way to form bundles; in this case, all the notes, not only within one bundle but also in successive bundles, have a consecutive sequence of numbers. Since it is no longer necessary for individual sheets to be cut and for the individual notes produced to be collected and since no sorting of bundles of notes from various stacks of notes is required during the formation of the packs of notes, the processing of the sheets of notes by the process according to the invention is speeded up and simplified.

Expedient ways of carrying out the process according to the invention emerge from the dependent claims.

BRIEF DESCRIPTION OF THE DRAWINGS

The invention is explained in more detail by two exemplary embodiments with reference to the drawings, in which:

FIG. 3 shows a diagrammatic representation of numbered stacks of notes which originate from a stack of sheets, FIG. 5 shows a diagrammatic representation of numbered stacks of notes which originate from a stack of sheets which has been processed by an apparatus according to FIG. 4.

DESCRIPTION OF THE PREFERRED EMBODIMENTS

Figures 1, 1A:
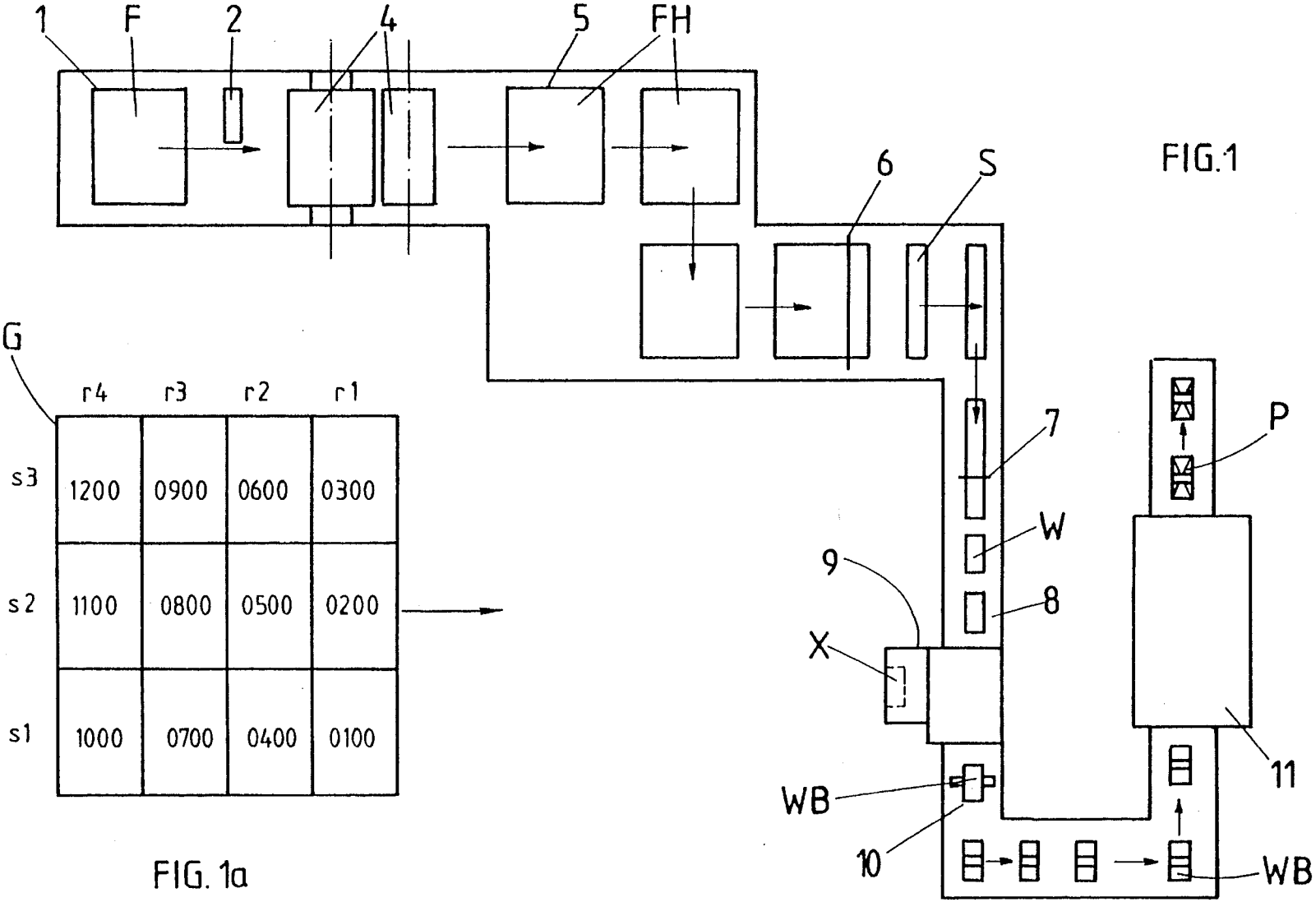
FIG. 1 shows in diagrammatic representation an apparatus for carrying out the process according to the invention.
FIG. 1*a* shows the last sheet of a numbered stack of sheets with numbered note positions.

According to FIG. 1, to start with there is a stack of sheets F, which is arranged on a feed table 1 upstream of the numbering machine 4 and which has a sequence of at least H sheets of notes. Each sheet of notes is printed with a fixed number of N note prints, which are arranged in matrix form in transverse rows, referred to hereinafter as rows, and in longitudinal rows, referred to hereinafter as columns. Sequences having in each case the same fixed number H of sheets of notes are processed one after the other, this number H being chosen, for example, to be 100, as assumed in the example considered.

Since successive stacks of sheets FH having in each case H numbered sheets of notes are formed at the output of the numbering machine 4 and each stack FH has to be cut in cutting units to form stacks of bundles, as explained later, the maximum permissible number H of a sheet sequence depends on the cutting capacity of the cutting units and can, correspondingly, also be chosen to be greater than 100 in order to speed up the processing.

The number of sheets of notes stacked on the feed table 1 should be that much greater than H that the stack to be numbered is always adequately large in order to process one sheet sequence successively after the other without interruption.

Before the numbering of a sequence of H sheets, that is to say in the example considered 100 sheets, is commenced, each sheet of notes of this sequence must be checked for misprints, the distribution of these misprints on each sheet must be determined and this misprint distribution must be stored in a computer. This computer is used to control the numbering machine, which has numbering units which can be controlled independently of one another, or are freely programmable.

The detecting of misprints may be carried out either automatically with the aid of an electronic quality control, the reading device of which stores the note positions of the detected misprints in the computer, or else a visual quality control is carried out, in which the detected misprints are provided with a marking; the sheets then pass a reading device, which reads these markings and stores the note positions concerned in the computer.

In any case, it is thus necessary that the distribution of the misprints within the sequence of H sheets, that is to say in the example considered of 100 sheets, is known before the beginning of numbering. In the block diagram according to FIG. 2, it is diagrammatically represented that the note positions of the misprints, determined in a quality control station Q for each sheet, are entered into the computer 3, which stores these positions and later controls the numbering machine 4. Furthermore, the station Q controls a marking device M, which provides each sheet with an identification mark, for example a bar code. If appropriate, furthermore there may also be provided a marking of the misprints with an invalidation imprint, these misprint markings expediently being controlled likewise by the station Q.

For processing, the sheets are first of all sent as a control past a reading device 2, which reads the identification marks, so that the association of the sheets with the information on the misprints stored in the computer 3 can be checked once again before numbering. Subsequently, the sheets run through the numbering machine 4. The numbering units are programmed, controlled by the computer 3, in such a way that misprints are excluded from the numbering, that is to say are skipped, and that the 100 sheets of the sequence F are numbered in such a way that all N×H, that is to say in the example considered N×100, notes of this sequence receive a consecutive sequence of numbers. All the note prints which have the same note position on successive sheets are in each case consecutively numbered, and the sequence of numbers of 100 notes in one and the same note position is the continuation of the sequence of the numbers of the 100 notes in a neighboring note position, or the note position of a neighboring row or column. A numbering example is explained later.

At the output of the numbering machine, the sheets pass on to a stack delivery 5, where the 100 sheets of the sequence from the stack F are once again laid one on top of the other to form a stack of sheets FH. These stacks FH are fed in the direction of the arrows according to FIG. 1 to a strip cutting unit 6 and are cut into stacks of strips S. These stacks of strips pass in the direction of the arrows to a further cutting unit 7, in which the stacks of strips S are cut into stacks of notes W. These stacks of notes with 100 notes each, contain consecutively numbered satisfactory notes and, if appropriate, unnumbered misprints and are pushed forward on the transporting zone 8.

For the example considered, the numbering of the first sequence of sheets is to be explained in more detail with reference to FIGS. 1*a* and 3. FIG. 1*a* shows the uppermost sheet of notes G of the completely numbered stack of sheets FH formed at the output of the numbering machine 4, that is to say the last-numbered sheet of notes of this stack, to be precise in the case where this stack FH has no misprints. In the example considered, it is assumed that the number of note prints per sheet is N=12 and these note prints are arranged in four rows r1 to r4 and in three columns s1 to s3, the rows extending transversely with respect to the transporting direction of the sheets in the numbering machine and the columns extending in the transporting direction.

The numbering units of the numbering machine 4 are programmed in such a way that the note prints in the position r1, s1, that is to say the note prints of all 100 successive sheets lying in the first row and in the first column, receive the numbers 0001 to 0100, the note prints lying in the note position r1, s2 receive the subsequent number sequence 0101 to 0200, etc. The number 0300 of the last-numbered note print in the position r1, s3 is followed by the sequence of numbers 0301 to 0400 of the note prints in the position r2, s1, etc. The note prints in the position r4, s3 finally receive the sequence of numbers 1101 to 1200. In this way, all the 12×100=1200 note prints of the first stack of sheets FH are thus consecutively numbered from 0001 to 1200, and the sequence of packs of notes W, resulting after cutting, on the transporting zone 8, is ordered according to this sequence of numbers 1 to 1200, if there are no misprints. The numbering example described above with reeference to FIG. 1*a* thus relates to the case in which there are no misprints.

If misprints occur, which are skipped during numbering, the numerical values on the last sheet of the numbered stack FH are of course reduced according to the number of misprints which occurred in the individual note positions, and the last number in the note position r4, s3 of the uppermost sheet of the stack of sheets is equal to 1200 minus the number of misprints there are.

FIG. 3 diagrammatically illustrates some of the stacks of notes W produced from the first numbered stack FH in the case where the first stack of notes, corresponding to the note position r1, s1, the stack W(r1, s1), contains one misprint X, the second stack of notes, corresponding to the note position r1, s2, the stack W(r1, s2), contains two misprints X and the third stack of notes, corresponding to the note position r1, s3, the stack W(r1, s3), contains one misprint X. Therefore, the last, uppermost note of the first stack of notes has the number 0099, the first, lowermost note of the second stack of notes has the number 0100, the uppermost note of this second stack has the number 0197, and the uppermost note of the third stack has the number 0296. The misprints X are provided in FIG. 3 with an invalidation cross. Corresponding numbering changes arise for the remaining stacks of notes W, which may likewise contain misprints.

In other words, the numbering of the 100 sheets of a sequence of sheets takes place in such a way that, after cutting, the stacks of notes laid one on top of the other form a connected sequence of numbers, the defective notes having been skipped during the numbering.

In short, the numbering units of the numbering machine 4 are thus programmed in such a way that, taking into consideration the later cuts and the transporting sequence of the stacks of strips S and of the stacks of notes W, the sequence of numbers of the notes in a stack of notes on the transporting zone 8 is exactly the continuation of the sequence of numbers the notes of the preceding stack of notes.

The stacks of notes W leaving the cutting unit 7 pass from the transporting zone 8 into a segregating and bundling device 9, into which the notes of successive stacks of notes are entered in the correct sequence of numbers. In this device 9, all the misprints X are segregated and subsequently in each case 100 successive satisfactory notes are combined to form a new bundle of notes WB. Such devices in which the notes of a stack are individually separated, misprints are segregated and bundles of notes are again formed thereafter are known.

The bundles WB are provided in a banderoling station 10 with a banderoll and are then transported in the direction of the arrow to a packing station 11. In this station 11, in each case 10 successive banderoled bundles of notes WB are packed to form packs P, which contain 1000 consecutively numbered notes of value.

It should be noted that, if misprints are present, the bundles of notes WB at the output of the device 9 do not correspond to the stacks of notes W upstream of the device 9; the missing numbers in the presence of misprints in a stack of notes W are in each case taken in the device 9 from the following stack of notes W, in order to form new bundles WB with a consecutive sequence of one hundred.

Figure 2:
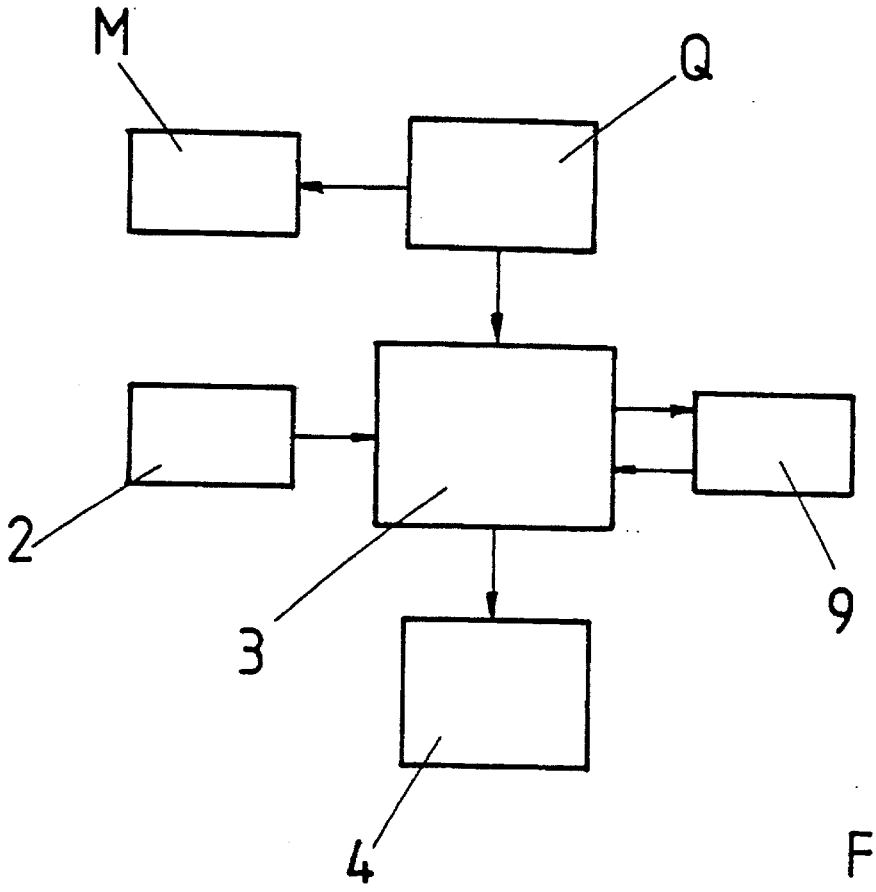
FIG. 2 shows a simplified block diagram of the control of the apparatus according to FIG. 1.

The controlling of the segregation in the device 9 takes place, as diagrammatically shown in FIG. 2, by the computer 3, in which the distribution of the misprints on each sheet of notes is stored. For control purposes, a properly carried out segregation is reported back to the computer 3.

If the misprints are provided with an invalidation marking, the segregation may also be carried out with the aid of a reading device responding to this marking.

Once a sequence of sheets of the stack F has been completely numbered, before the beginning of numbering of the next sequence of sheets and after storage of the misprint distribution within this sequence of sheets, the numbering units of the numbering machine 4 are switched by the computer 3 in such a way that there is a smooth transition in the sequence of numbers. If, for example, the last sheet of the first stack FH at the last note position r4, s3 has received the last number 1189, because altogether there were 11 misprints, the numbering unit which prints the number of the first sheet of the second sequence of sheets at the first note position r1, s1 is set to 1190; taking into consideration that the misprint distribution in the second sequence of sheets, the other numbering units are set correspondingly.

In order finally to replace the missing notes, resulting from the segregation of misprints, the apparatus may be programmed in such a way that at the end of the numerical series so many additional sheets have been numbered that the numerical series is complete.

If the sorting capacity of an individual segregation and bundling device is not adequate, that is to say significantly less than the capacity of the numbering machine and of the packing device, the number of these segregation and bundling device may be increased for the purpose of parallel operation. For this purpose, each sheet is divided into a plurality of subregions, and the number of sorting and bundling devices is chosen to be equal to the number of these subregions. The numbering machine must then be programmed in such a way that a consecutive numbering is carried out within the same subregion of all the sheets, the numbers of different subregions differing, for example, by different series letters. Such an example is represented diagrammatically in FIGS. 4, 4*a* and 5. According to this, each sheet of notes is subdivided into three subregions, identified by the series letters A, B and C, and has, as in the case of the first exemplary embodiment, 12 note prints, which are arranged in four rows r1 to r4 and three columns s1 to s3, the subregions A, B and C in each case comprising one of the three columns.

Figures 4, 4A:
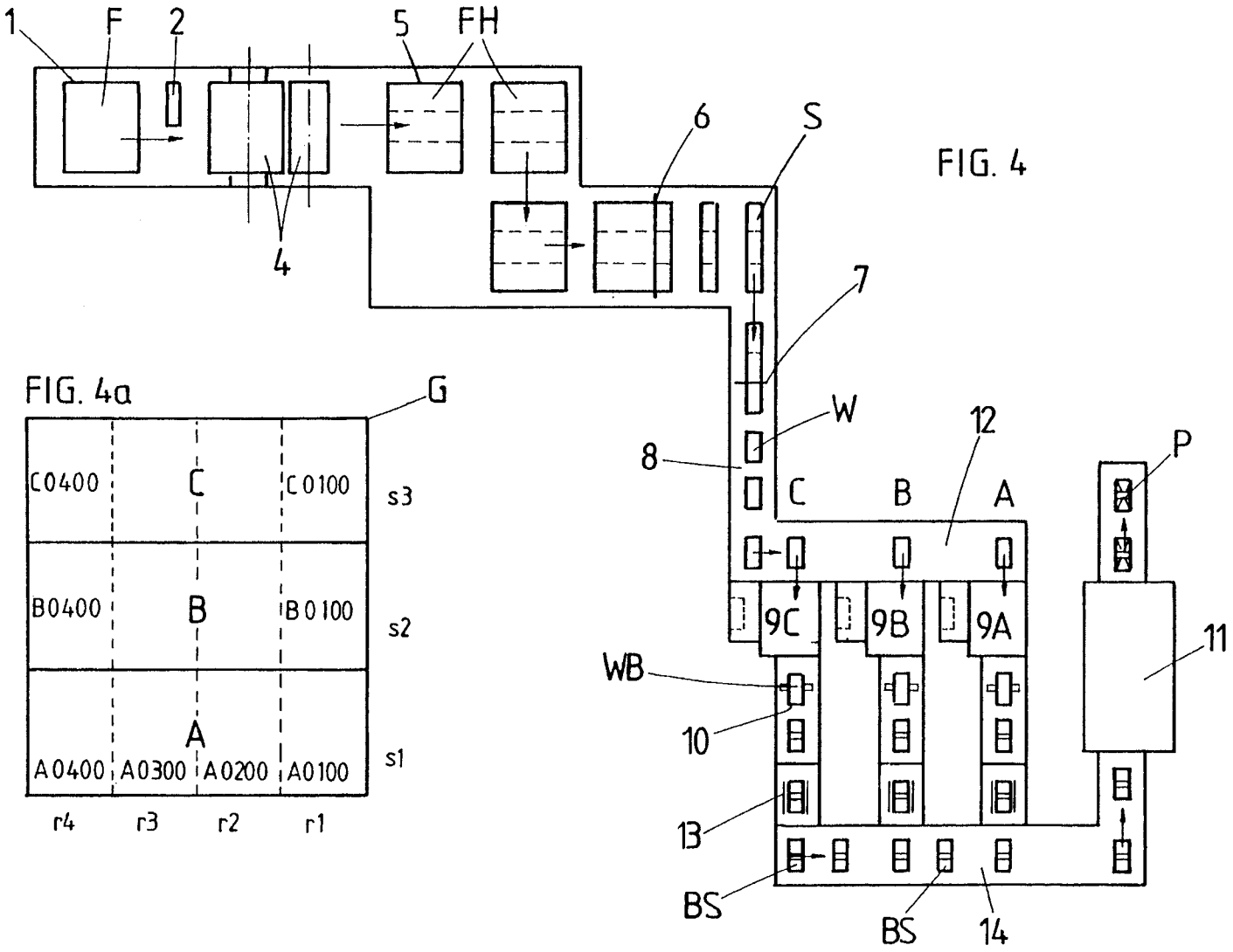
FIG. 4 shows a representation corresponding to FIG. 1 of an apparatus for carrying out a second embodiment of the process according to the invention.
FIG. 4*a* shows the last sheet of a numbered stack of sheets with numbered note positions in the case of the apparatus according to FIG. 4.

The processing of the stack of sheets FH takes place up to production of the stacks of notes W in the cutting unit 7 as in the case of the first exemplary embodiment, only each of the subregions being numbered within itself. In the example considered, the numbering begins in each subregion with the first number, that is to say with the number 0001, the note position r1, s1 of the subregion A of the first sheet receiving the number A 0001, the note position r1, s2 of the subregion B of the first sheet receiving the number B 0001 and the note position r1, s3 of the subregion C receiving the number C 0001. The sequences of numbers then continue within each subregion in the rows r2 to r4. FIG. 4*a* shows the numbers of the last sheet G of the stack FH in the case where there are no misprints. Then, the note position r1, s1 has the number A 0100, the note position r1, s2 has the number B 0100, etc., the note position r2, s1 has the number A 0200, etc., and finally the note position r4, s3 has the number C 0400.

In the example according to FIG. 5, it is assumed that, as in the case of the first exemplary embodiment, within the stack of sheets FH there is one misprint X at the note position r1, s1, two misprints X at the note position r1, s2 and likewise one misprint X at the note position r1, s3, so that the last-numbered, uppermost sheet in the row r1 receives the numbers A 0099, B 0098 and C 0099.

The successive stacks of notes W downstream of the cutting unit 7 according to FIG. 4 on the transporting zone 8 belong alternately to the subregions A, B and C. After changing the transporting direction through 90, they are transported on a transporting zone 12 in front of the thre parallel-arranged segregation and bundling devices 9A, 9B and 9C and are then processed simultaneously in parallel operation in these devices, that is to say all the misprints are removed, the segregation again being controlled by the computer, and subsequently 100 successive satisfactory notes having a complete sequence of numbers are each combined to form bundles WB, which are surrounded by a banderoll in the three banderoling stations 10. Each banderoling station is followed downstream by a collecting station 13, in which ten banderoled bundles are in each case combined to form a stack of ten bundles. In this way stacks of bundles BS are produced, which contain a consecutive thousand-numbering of one of the former subregions A, B or C. All the stacks of bundles BS pass via a common transporting zone 14 to a packing station 11, in which the stacks of bundles are banderoled and are packed to form packs P having in each case 1000 consecutively numbered notes of value.

The numbering method described above can of course also be used with advantage if exclusively sheets of notes with satisfactory note prints are processed, that is to say if all sheets having misprints have already been removed from the sequences of in each case H sheets which are fed to the numbering machine 4. Then the processing of these sheets of notes to form packs of notes takes place using a numbering machine with freely programmable and correspondingly controlled numbering units in exactly the same way as described before with reference to FIG. 1, with the only exception that the segregation and bundling device 9 is dispensed with. In this case, the notes of all the stacks of notes W successively leaving the cutting unit 7 are consecutively numbered within each stack and the notes of successive stacks of notes W have a consecutive sequence of numbers. These stacks of notes W may then be banderoled directly by means of a banderoling machine 10 to form bundles of notes, in this case a stack of notes W and a bundle of notes WB being identical. The apparatus thus then corresponds exactly to the apparatus according to FIG. 1, but omitting the segregation and bundling device 9.

In general, sequences having in each case 100 sheets of notes are processed, so that H is thus equal to 100. In this case, in the absence of misprints, the stacks of notes W and consequently the banderoled bundles of notes WB of course each have 100 notes of value.

In principle, however, sequences having a different number of sheets may also be processed, provided that the cutting units 6 and 7 allow the cutting of stacks with such a number of sheets or strips. This applies both to the case where misprints have to be segregated and to the case where the processed sheets of notes do not contain any misprints. If in the latter case the sequences of sheets to be processed have a number other than 100, for example 200 or 250 sheets each, the banderoled bundles of notes of course have the same number of notes of value.

The simplified version of the process for the case where there are no misprints, and the apparatus simplified in this respect are the subject of process claim 6 and apparatus claim 8.

The invention is not restricted to the exemplary embodiments described, in particular not to the arrangements described of the transporting zones and cutting units, but allows many different variants, in particular also with respect to the possible arrangement and number of subregions into which the sheets of notes can be subdivided for the purpose of numbering, and with respect to the corresponding number of segregation and bundling devices when there are misprints.

I claim:

1. Process for processing sheets of notes having a fixed number N of note prints, which are arranged on each sheet in transverse rows and longitudinal rows, to form bundles of notes (WB) from numbered individual notes of value and to form packs of notes (P), which contain a particular number of bundles of notes and in which all the notes have a consecutive, complete sequence of numbers, the process includes cutting sheets of notes and registration of misprints established on the sheets of notes, in which process, after registration of the misprints established on them, the sheets of notes run through a numbering machine (4), in which only the satisfactory note prints are numbered, excluding the misprints, and in which process, after the cutting of the sheets of notes, the misprints are segregated, wherein the distribution of the misprints (X) on each sheet of a sequence of at least H sheets is established and stored before their numbering, wherein then a sequence of H successive sheets is numbered as a function of this stored misprint distribution in such a way that all the satisfactory note prints of this sequence receive a consecutive sequence of numbers, the satisfactory note prints which have the same note position on successive sheets being consecutively numbered and all the sequences of numbers of the in each case H note prints in adjacently lying note positions of the same row receiving a consecutive numbering, the sequences of numbers of the note prints in all the note positions of a row continuing the sequences of numbers of the note prints in the note positions of a neighboring row, and the next sequence of H sheets receiving the subsequent sequence of numbers, wherein at the output of the numbering machine (4) stacks of sheets (FH) having H sheets each are formed, these stacks of sheets are cut into stacks of strips (S) and these stacks of strips are cut into stacks of notes (W) and the stacks of notes occurring one after the other in rows are successively sent through at least one segregation and bundling device (9), in which the misprints (X) are removed and in each case H successive satisfactory notes are combined to form a bundle (WB) having a complete sequence of numbers, bundles following one another having notes with successive sequences of numbers.

2. The process as claimed in claim 1, wherein a numbering machine (4) with freely programmable printing units is used, which units are programmed on the basis of the known distribution of the misprints (X) in the sequence of sheets to be numbered in such a way that, after the cutting of a stack of sheets (FH) with H sheets, there are produced stacks of notes (W) which, laid one on top of the other, form a connected sequence of numbers, the misprints having been skipped during the numbering.

3. The process as claimed in claim 1, wherein the misprints are provided with an invalidation marking.

4. The process as claimed in claim 1, wherein when establishing the misprint distribution, the sheets are provided with an identification mark and, before numbering, pass a reading device (2), which reads these marks and checks the assignment of the sheets to the stored misprint distribution.

5. A process for processing sheets of notes having a fixed number N of note prints, which are arranged on each sheet in transverse rows and longitudinal rows, to form bundles of notes (WB) from numbered individual notes of value and to form packs of notes (P), which contain a particular number of bundles of notes and in which all the notes have a consecutive, complete sequence of numbers, the process includes segregation of sheets having misprints, in which process, after segregation of sheets having misprints, the sheets of notes run through a numbering machine, in which the note prints of all the sheets are numbered, wherein in each case a sequence of H successive sheets is numbered and all the N×H note prints of this sequence of sheets H receive a consecutive sequence of numbers, the note prints which have the same note position on successive sheets being consecutively numbered and all the sequences of numbers of the in each case H note prints in adjacently lying note positions of the same row receiving a consecutive numbering, the sequences of numbers of the note prints in all the note positions of a row continuing the sequences of numbers of the note prints in the note positions of a neighboring row, and the next sequence of H sheets of notes receiving the subsequent sequence of numbers, and wherein the H numbered sheets of notes of a sequence are cut stack by stack into stacks of strips and these stacks of strips (S) are cut into bundles of notes in such a way that the bundles of notes (WB) occurring one after the other in rows of a sequence of H sheets having consecutively numbered notes and the bundles of notes occurring one after the other in rows of the subsequent sequence of H sheets have notes with the subsequent sequence of numbers.

6. Process for processing sheets of notes having a fixed number N of note prints, which are arranged on each sheet in transverse rows and longitudinal rows, to form bundles of notes (WB) from numbered individual notes of value and to form packs of notes (P), which contain a particular number of bundles of notes and in which all the notes have a consecutive, complete sequence of numbers, the process includes cutting sheets of notes and registration of misprints established on the sheets of notes, in which process, after registration of the misprints established on them, the sheets of notes run through a numbering machine (4), in which only the satisfactory note prints are numbered, excluding the misprints, and in which process, after the cutting of the sheets of notes, the misprints are segregated, wherein the distribution of the misprints (X) on each sheet of a sequence of at least H sheets is established and stored before their numbering, wherein the numbering units of the numbering machine (4) are programmed in such a way that each sheet is divided up for numbering into a particular number of subregions (A,B,C), wherein then a sequence of H successive sheets is numbered as a function of this stored misprint distribution in such a way that all the satisfactory note prints of this sequence within the same subregion (A,B,C) receive a consecutive sequence of numbers, the note prints which have the same note position on successive sheets being consecutively numbered and all the sequences of numbers of the in each case H note prints in all note positions of said subregion (A,B,C) form one consecutive number sequence, the next sequence of H sheets receiving the subsequent sequence of numbers, wherein at the output of the numbering machine (4) stacks of sheets (FH) having H sheets each are formed, these stacks of sheets are cut into stacks of strips (S) and these stacks of strips are cut into stacks of notes (W) and the stacks of notes occurring one after the other in rows and originating from the same stack of sheets and belonging to the various subregions run through as many parallel-operating segregation and bundling devices (9A, 9B, 9C) as there are subregions, whereby the misprints (X) are removed and in each case H successive satisfactory notes are combined to form a bundle (WB) having a complete sequence of numbers, bundles following one another having notes with successive sequences of numbers.

* * * * *